United States Patent [19]

Marcotte

[11] 4,414,991

[45] Nov. 15, 1983

[54] APPARATUS FOR USE IN CUTTING HAIR

[76] Inventor: Bernadine A. Marcotte, 10515 Prouty Rd., Painesville, Ohio 44077

[21] Appl. No.: 418,754

[22] Filed: Sep. 16, 1982

[51] Int. Cl.[3] ..... A45D 24/36

[52] U.S. Cl. ..... 132/45 R

[58] Field of Search ..... 132/45 R, 43 R, 7; 128/DIG. 15

[56] References Cited

U.S. PATENT DOCUMENTS

| | | | |
|---|---|---|---|
| 459,012 | 9/1891 | Marsh | 132/45 R |
| 2,698,018 | 12/1954 | Post | 132/45 R |
| 2,722,940 | 11/1955 | Bohannon | 132/45 |
| 3,000,384 | 9/1961 | Piers, Jr. | 128/DIG. 15 |
| 3,928,871 | 12/1975 | Wall | 132/45 R |
| 3,993,083 | 11/1976 | Torres | 132/45 R |
| 4,206,772 | 6/1980 | Koepp | 132/43 R |

*Primary Examiner*—Gregory E. McNeill
*Attorney, Agent, or Firm*—Yount & Tarolli

[57] ABSTRACT

An improved apparatus for cutting hair includes a pair of panels which are pivotally interconnected for movement between an open position in which the panels are spaced apart from each other and a closed position in which major sides of the panels are disposed in a side-by-side relationship. Each of the panels has a nonlinear pattern edge portion which is used to guide a haircutting device, such as scissors or a razor, or clippers along a nonlinear path. The pattern edge portions of the two panels have the same configuration with crests projecting outwardly away from base edge portions of the panels and troughs between the crests. In order to comb the hair and retain it against sidewise movement along the pattern edge portions, a large number of bristles extend outwardly from a major side of one of the panels. The hair is laid across the bristles when the panels are in the open position. The other panel is then clamped against the bristles to hold the hair.

9 Claims, 9 Drawing Figures

APPARATUS FOR USE IN CUTTING HAIR

BACKGROUND OF THE INVENTION

The present invention relates to a new and improved apparatus for use in cutting hair and more particularly an apparatus for use in cutting hair in a nonlinear pattern in which the length of the hair varies.

It has previously been suggested that a templet could be used as a guide to facilitate the trimming of hair in the manner shown in U.S. Pat. No. 3,993,083. The templet shown in this patent includes a pair of plates which are pivotally interconnected. The plates have a straight edge along which hair is cut to trim it to a desired length. The straight edge of the templet results in the hair being cut along a straight line. Other known devices for use in trimming hair are disclosed in U.S. Pat. Nos. 459,012; 2,722,940; and 3,928,871.

SUMMARY OF THE PRESENT INVENTION

The present invention provides a new and improved apparatus for use in cutting hair in a nonlinear pattern so that the length of the hair varies. The apparatus includes a pair of panels which have pattern edges to guide a device for cutting the hair. The pattern edges have crests and troughs which are aligned when the panels are in a closed side-by-side relationship. A large number of bristles are advantageously provided on the inner major side of one of the panels to comb the hair and hold it against sidewise movement.

Accordingly, it is an object of this invention to provide a new and improved apparatus for use in cutting hair and wherein the apparatus includes panels having pattern edge portions to guide a device to cut hair along a nonlinear path extending along crests and troughs of the pattern edge portions on the panels.

Another object of this invention is to provide a new and improved apparatus as set forth in the preceding object and wherein an array of bristles is disposed between major side surfaces of the panels to hold the hair against sidewise movement relative to the panels.

BRIEF DESCRIPTION OF THE DRAWINGS

The foregoing and other objects and features of the present invention will become more apparent upon a consideration of the followng description taken in connection with the accompanying drawings wherein.

DESCRIPTION OF SPECIFIC PREFERRED EMBODIMENTS OF THE INVENTION

Figure 1:
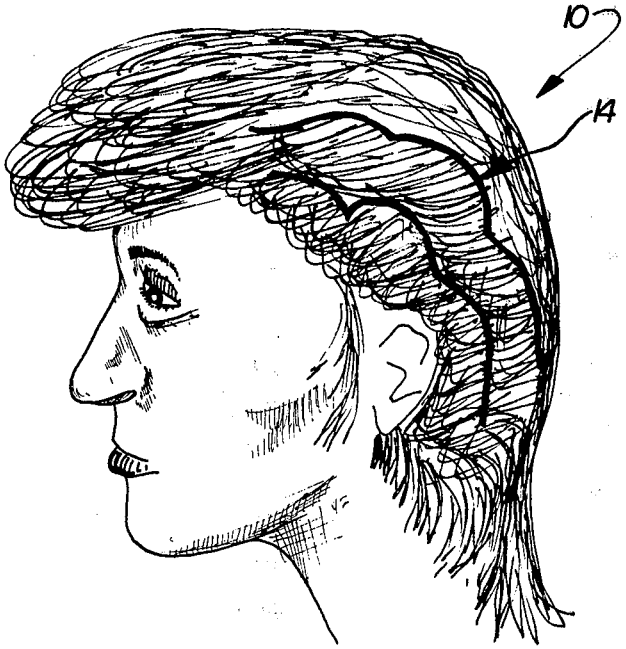
FIG. 1 is an illustration of hair cut with a templet constructed in accordance with the present invention.

An improved hairstyle 10 (FIG. 1) is cut to have scalloped patterns or waves which give the hair a controlled texture. The scalloped or patterned cut makes fine hair appear fuller and bulky hair more movable. The patterned or scalloped effect is obtained by using a templet 12 (see FIGS. 2 and 3) constructed in accordance with the present invention. In using the templet, the length of the hair varies in a scalloped pattern 14, which has been emphasized in FIG. 1 for purposes of illustration.

By cutting the hair to a nonlinear pattern, the ends of the hair give more movement and volume to the hair and provide a waving action which causes the hair to arc out away from the head to thereby increase the movement and volume of the hair. Of course, the templet 12 can be used to cut many different hairstyles other than the hairstyle 10 shown in FIG. 1.

The templet 12 is used for cutting the hair in a nonlinear pattern, that is, a pattern which is not straight so that the length of the hair varies. The templet 12 includes a base panel 18 (FIG. 2) and a cover panel 20 which are pivotally interconnected at a hinge joint 22. The panels 18 and 20 are movable between the open condition of FIG. 2 and the closed condition of FIG. 3 to clamp stands of hair 26 between the two panels 18 and 20.

Figure 3:
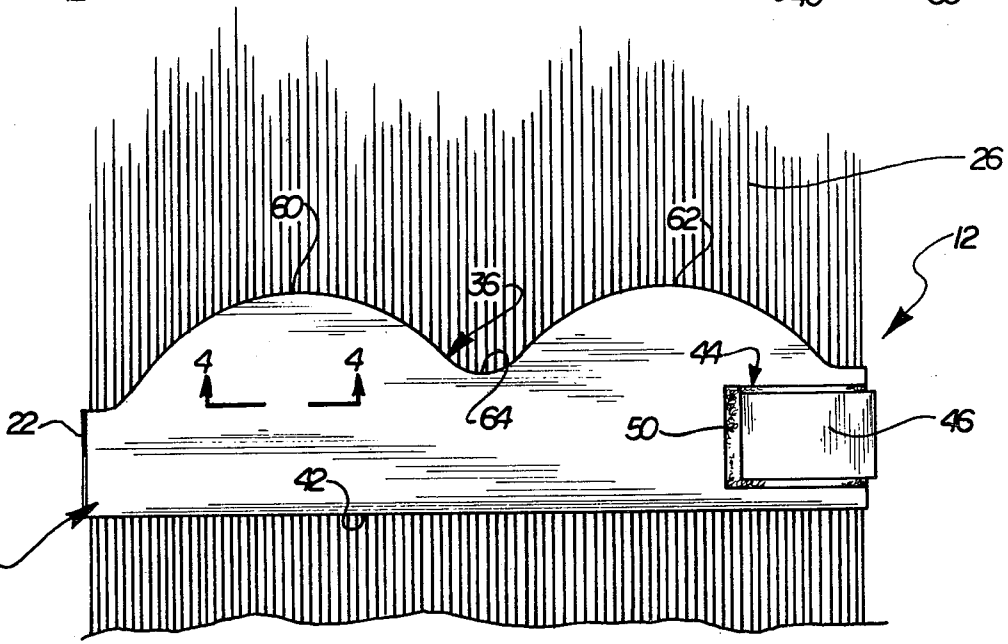
FIG. 3 is a plan view of the templet of FIG. 2 in a closed position and illustrating the relationship between the templet and hair to be cut.

In the closed position of FIG. 3, major inner sides 30 and 32 of the panels 18 and 20 are disposed in a side-by-side relationship with the pattern edge portions 34 and 36 disposed in alignment with each other. This enables the pattern edge portions 34 and 36 to be used to guide movement of a cutting instrument, such as scissors, razor or clippers along a nonlinear path having a configuration corresponding to the configuration of the pattern edge portions 34 and 36.

Figure 2:
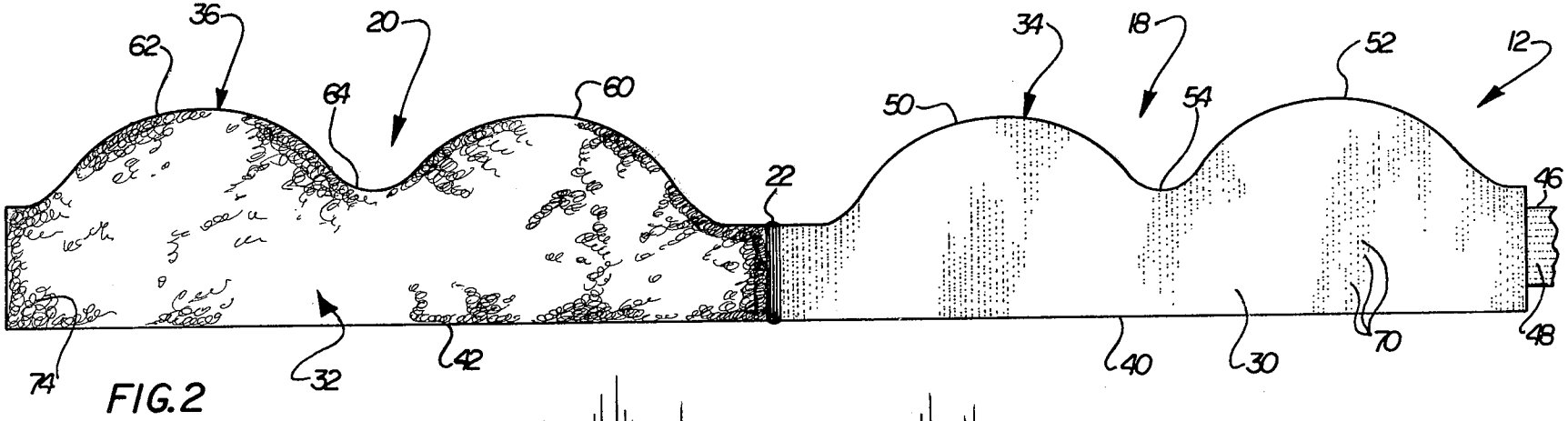
FIG. 2 is a plan view of the templet in an open position.

When the panels 18 and 20 are in the open condition of FIG. 2, the strands of hair 26 are placed on the major side 30 of the base panel 18. A cover panel 20 is then pivoted about the hinge connection 22 to press the strands of hair against the base panel 18. The free ends of the hair extend outwardly from the pattern edge portions 34 and 36 of the closed panels (FIG. 3). The portion of the hair leading to the scalp extends head from linear base edge portions 40 and 42 (FIG. 3) of the panels 18 and 20.

A fastener arrangement 44 holds the panels 18 and 20 in the closed position of FIG. 3 while the hair is cut. While other types of fasteners could be used, in the illustrated embodiment of the invention, a strap 46 (FIG. 2) is connected with one end of the base panel 18. The strap 46 has an inner side surface 48 from which a plurality of bristles extend. These bristles engage a fibrous mat 50 (FIG. 3) on the base panel 20 to hold the panels in the closed condition. The strap 46 and fibrous base 50 are sold under the trademark "Velcro".

In accordance with a feature of the present invention, the pattern edge portions 34 and 36 have a nonlinear configuration. Thus, the pattern edge portion 34 on the base panel 18 has arcuately curving crests 50 and 52

(FIG. 2) with a trough 54 between the crests. Similarly, the pattern edge portion 36 on the cover panel 20 has arcuately curving crests 60 and 62 with a trough 64 between the crests. Although the crests and troughs 50, 52, 54, 60, 62 and 64 have a curving configuration, it is contemplated that they could have other configurations if desired.

When the panels 18 and 20 are in the closed condition of FIG. 3, the crests 50 and 52 and trough 54 on the pattern edge portions 34 are aligned with the crests 60 and 62 and trough 64 on the pattern edge portion 36. Thus, the crest 60 on the panel 20 has the same configuration as the crest 50 on the panel 18. Similarly, the crest 62 of the panel 20 has the same configuration as the crest 52 on the panel 18. The troughs 64 and 54 also have the same configuration. Therefore, when the panels 18 and 20 are moved to the closed condition shown in FIG. 3, the crests 50, 52, 60 and 62 are disposed in a side-by-side relationship and are aligned with each other. The troughs 54 and 64 are disposed in a side-by-side relationship and are aligned with each other.

The aligned pattern edge portions 34 and 36 are formed by the minor sides of the panels 18 and 20 and provide surfaces for guiding movement of a scissors or other cutting instrument along a path having the same configuration as the pattern edge portions. Therefore, when the cutting instrument is moved along the pattern edge portion of the closed templet 12 (see FIG. 3) each of the strands of hair 26 is cut to a length determined by the position of the strands of hair along the pattern edge portions 34 and 36 of the panels 18 and 20. As the hair is cut, a portion of the wave 14 (see FIG. 1) is cut in the ends of the hair.

Figure 4:
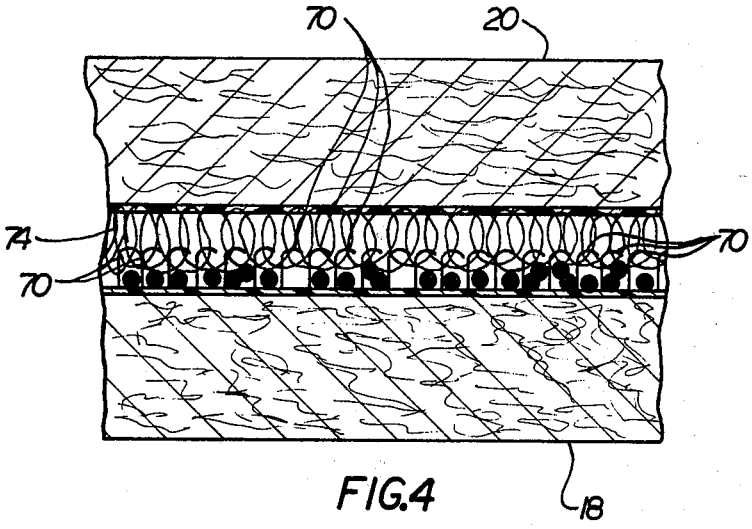
FIG. 4 is an enlarged fragmentary sectional view, taken generally along the line 4—4 of FIG. 3, illustrating the relationship between an array of bristles projecting from a major side of a panel of the templet of FIGS. 1 and 2 and a plurality of strands of hair.

In order to comb and straighten the hair and then to hold it against sidewise movement along the pattern edge portions 34 and 36, an array of bristles 70 (FIGS. 2 and 4) project from the inner side 30 of the panel 18 throughout the extent of the panel. When the templet 12 is in the open condition of FIG. 2, the strands of hair 26 are laid over the bristles 70 on the base panel 18. The cover panel 20 is then closed against the base panel 18. This results in the hair being trapped between the bristles 70 and the two panels 18 and 20.

The closed templet 12 is then moved away from the head of a person whose hair is being cut. This pulls the hair taut between the templet 12 and the scalp to comb the hair. The bristles 70 keep the hair from moving sideways and bunching up at various locations along the pattern edge portions 34 and 36.

In order to prevent the bristles 70 from being flattened and deflected by the cover panel 20, a fibrous mat 74 (FIGS. 2 and 4) forms the major side 32 of the cover panel 20. The free ends of the bristles 70 project into the fibrous mat 74 when the panels 18 and 20 are in the closed condition of FIG. 3. Therefore, the filaments of the fibrous mat 74 press the strands of hair against the base panel 18 (see FIG. 4).

The base panel 18 and cover panel 20 may be formed of a relatively stiff plastic or fiberboard material. The bristles 70 and fibrous mat 74 are mounted on these panels. The bristles 70 and fibrous mat are sold under the trademark "Velcro".

It is contemplated that the templet 12 could have configurations other than the configuration shown in FIGS. 2 and 3. In the embodiment of the invention shown in FIG. 5, the templet has relatively large troughs disposed on opposite sides of a narrow crest. Since the embodiment of the invention shown in FIG. 5 is generally similar to the embodiment of the invention shown in FIGS. 2 and 3, similar numerals will be used to designate similar components, the suffix letter "a" being used to designate the components of the embodiment of the invention shown in FIG. 5 to avoid confusion.

The templet **12*a* includes a base panel 18*a* and a cover panel 20*a*. The base panel 18*a* has pattern edge portions 34*a* and the cover panel 20*a* has a pattern edge portion 36*a*. The templet 12*a* is oriented with the pattern edge portions 34*a* and 36*a* facing toward the scalp of the person whose hair 26*a* is to be cut. Therefore, a cutting instrument is moved along the pattern edge portions 34*a* and 36*a* between the templet 12*a* and the scalp of the person whose hair is being cut. Of course the templet 12*a* could be used in the same orientation as the templet 12 in FIG. 3** if desired.

The pattern edge portions **34*a* and 36*a* on the base panel 18*a* and cover panel 20*a* have the same configuration. Thus, the pattern edge portion 36*a* and the cover panel 20*a* has a pair of arcuate troughs 78 and 80 with a crest 82 disposed between the two troughs. Of course, the base panel 18*a* has crests and troughs with the same configuration as the crests and troughs of the cover panel 20*a***.

Figure 5:
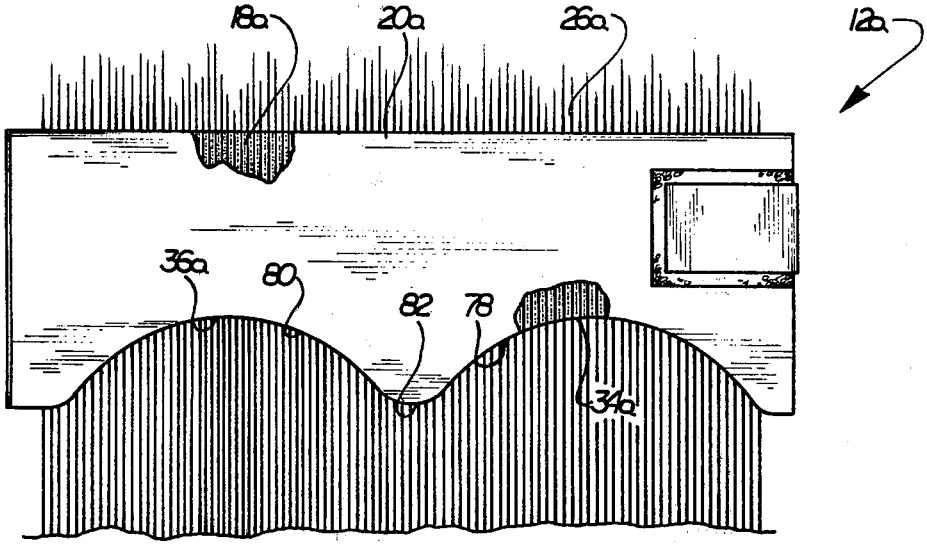
FIG. 5 is a plan view, generally similar to FIG. 3, of a second embodiment of the templet.
Figure 6:
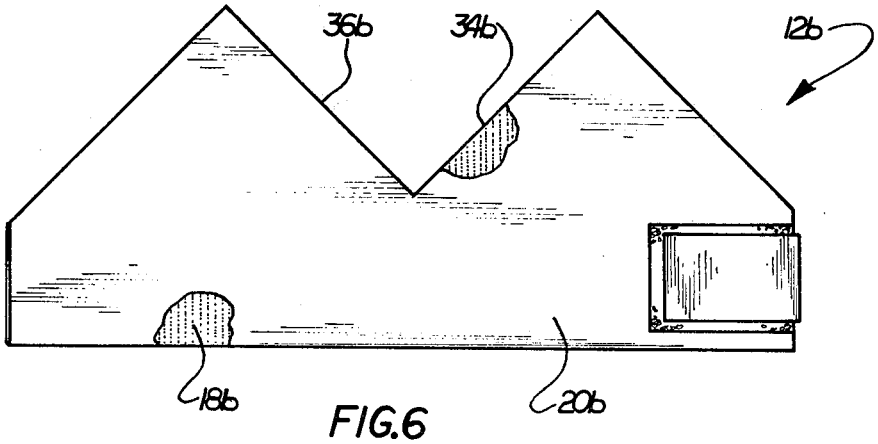
FIG. 6 is a plan view, generally similar to FIG. 5, of another embodiment of the templet.

In the embodiments of the invention shown in FIGS. 2, 3 and 5, the base and cover panels are provided with arcuate crests and troughs along the pattern edge portions. However, it is contemplated that the crests and troughs could be formed with straight sides. Thus, in the embodiment of the invention shown in FIG. 6, the crests and troughs on the cover and base panels are formed with linear sides. Since the embodiment of the invention shown in FIG. 6 is generally similar to the embodiment of the invention shown in FIGS. 2, 3 and 5, similar numerals will be utilized to designate similar components, the suffix letter "b" being associated with FIG. 6 in order to avoid confusion.

A templet **12*b* has a base panel 18*b* and a cover panel 20*b* with pattern edge portions 34*b* and 36*b*. The crests and troughs of the pattern edge portions 34*b* and 36*b* are formed by straight sides which intersect at sharply defined peaks and crests and at a sharply defined trough. Of course, the spacing between the peaks and troughs can be changed from the illustrated spacing to change the frequency of the waves formed in the hair. It is contemplated that the templet 12*b*** will be particularly advantageous for cutting curly hair.

Figure 7:
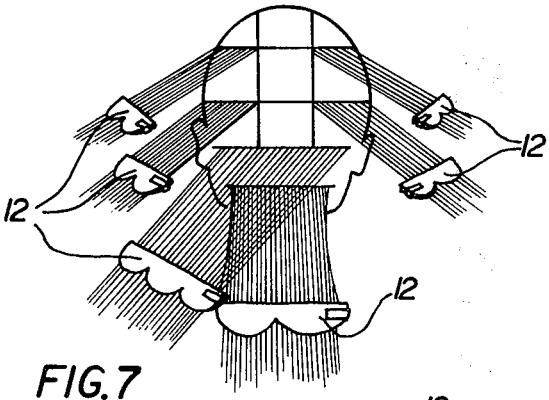
FIG. 7 is a schematic illustration of one way in which hairs on the back of a head may be parted and cut with the templet of FIGS. 2 and 3 to obtain the hairstyle similar to the one shown in FIG. 1.
Figure 8:
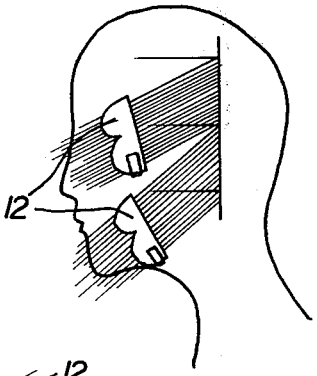
FIG. 8 is a schematic illustration, similar to FIG. 7, illustrating the manner in which the hair on the side of the head is cut with the templet.
Figure 9:
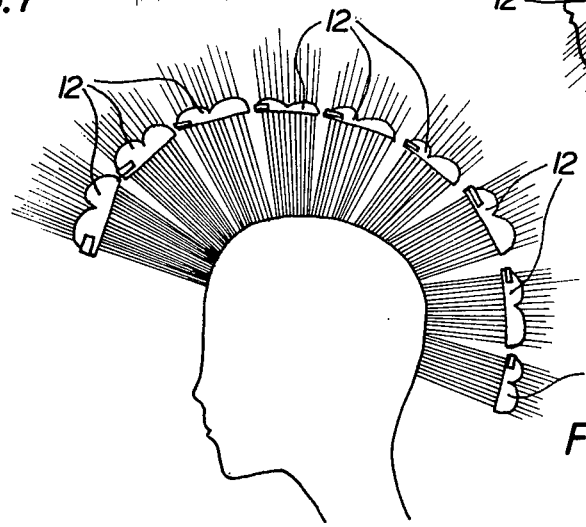
FIG. 9 is a schematic illustration, similar to FIGS. 7 and 8, illustrating the manner in which the templet is used to cut hair on the center portion of the head to form a hairstyle similar to the one shown in FIG. 1.

When hair is to be cut with the templet 12 to form the hairstyle of FIG. 1, the hair is first parted into sections in the general manner shown schematically in FIGS. 7, 8 and 9. Of course, the manner in which the hair is parted will depend upon the particular hairstyle in which the hair is to be cut and the texture of the hair. The templets 12, **12*a* and 12*b*** can be used to cut many different hairstyles and it is not intended that the invention should be limited to the particular hairstyle shown herein.

Once the hair has been parted, the templet 12 is used to cut the back hair in the manner illustrated schematically in FIG. 7. It should be noted that the hair is parted so that the hair in the central portion of the scalp is not cut.

The hair along the sides of the head (FIG. 8) are cut next with the templet 12. It should be noted that in cutting the hair along the sides of the head the orientation of the templet is reversed when cutting some of the hairs.

Finally, the hair in the central portion of the scalp is cut using the templet 12 in the manner shown schematically in FIG. 9. The resulting hairstyle, which has been illustrated schematically in FIG. 1, has a controlled texture and movement of the hair. This results from the scalloped effect with which the hair is cut with the templet 12. The scalloped effect makes fine hair appear fuller and bulky hair to be more movable.

In view of the foregoing it is apparent that the present invention provides a new and improved apparatus 12 for use in cutting hair in a nonlinear pattern so that the length of the hair varies. The apparatus 12 includes a pair of panels 18 and 20 which have pattern edges 34 and 36 to guide a device for cutting the hair. The pattern edges have crests 50, 52, 60 and 62 and troughs 54 and 64 which are aligned when the panels are in a closed side-by-side relationship (FIG. 3). A large number of bristles 70 are advantageously provided on the inner major side 30 of the panel 18 to comb the hair and hold it against sidewise movement.

Having described specific preferred embodiments of the invention, the following is claimed:

1. An apparatus for use in cutting hair to a nonlinear pattern in which the length of the hair varies, said apparatus comprising first and second panels, each of said panels having major sides extending between a first edge portion and a nonlinear pattern edge portion, said pattern edge portion on each of said panels including surface means for guiding a device to cut hair along a nonlinear path, said pattern edge portion on said first and second panels having the same configuration with crests projecting outwardly away from the first edge portions and troughs between the crests, said surface means on each of said panels being disposed along the outer edges of said crests and troughs to guide cutting of the hair at the crests and troughs with the hair cutting device, and connector means interconnecting said first and second panels for enabling said panels to move between an open condition in which the major sides of said panels are spaced apart so that hair can be positioned between said panels and a closed condition in which a first major side of said first panel is disposed in a side-by-side relationship with a first major side of said second panel with hair between the first major sides of said first and second panels, said crests of the pattern edge portion on said first panel being aligned with said crests of the pattern edge portion on said second panel and said troughs of the pattern edge portion on said first panel being aligned with said troughs of the pattern edge portion on said second panel when said panels are in the closed condition to enable said surface means to guide the hair cutting device to cut the hair disposed between the major sides of said first and second panels along a nonlinear path extending along the crests and troughs of the pattern edge portions on said first and second panels.

2. An apparatus as set forth in claim 1 further including hair retaining means extending outwardly from the first major side of said first panel for cooperating with the first major side of said second panel when said panels are in the closed condition to retain hair disposed between said panels against sidewise movement along the crests and troughs of the pattern edge portions on said first and second panels during cutting of the hair disposed between the major sides of the first and second panels.

3. An apparatus as set forth in claim 2 wherein said hair retaining means includes an array of bristles disposed between the surface means on the pattern edge portion and the first edge portion of said first panel, said array of bristles extending along the pattern edge portion of said first panel throughout the extent of the crests and troughs on the pattern edge portion of said first panel.

4. An apparatus as set forth in claim 3 wherein said first major side of said second panel includes mat means for receiving end portions of said bristles when said first and second panels are in the closed condition.

5. An apparatus as set forth in claim 1 further including means for holding said first and second panels in the closed condition.

6. An apparatus as set forth in claim 1 wherein said crests have a continuously curving configuration.

7. An apparatus as set forth in claim 1 wherein said crests each include a pair of straight sides which intersect at a peak.

8. An apparatus as set forth in claim 1 wherein said troughs have a continuously curving configuration.

9. An apparatus as set forth in claim 1 further including an array of bristles projecting from the first major side of said first panel at a location between the fist edge portion and pattern edge portion of said first panel, said bristles extending transversely to longitudinal axes of strands of hair and having side surface means for engaging the strands of hair to hold the strands of hair against sidewise movement along the crests and troughs of the pattern edge portions on said first and second panels during cutting of the hair with said first and second panels in the closed condition.

* * * * *

UNITED STATES PATENT AND TRADEMARK OFFICE

CERTIFICATE OF CORRECTION

PATENT NO. : 4,414,991

DATED : November 15, 1983

INVENTOR(S) : Bernadine A. Marcotte

It is certified that error appears in the above-identified patent and that said Letters Patent are hereby corrected as shown below:

Column 6, line 41, change"fist" to - - first - -.

Signed and Sealed this

Tenth Day of January 1984

[SEAL]

*Attest:*

GERALD J. MOSSINGHOFF

*Attesting Officer*

*Commissioner of Patents and Trademarks*